US011793300B2

(12) United States Patent
Ji et al.

(10) Patent No.: US 11,793,300 B2
(45) Date of Patent: Oct. 24, 2023

(54) ORAL CARE IMPLEMENT

(71) Applicant: Colgate-Palmolive Company, New York, NY (US)

(72) Inventors: Yanmei Ji, Suzhou (CN); Wen Jin Xi, Shanghai (CN)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 17/441,329

(22) PCT Filed: Mar. 22, 2019

(86) PCT No.: PCT/CN2019/079214
§ 371 (c)(1),
(2) Date: Sep. 21, 2021

(87) PCT Pub. No.: WO2020/191518
PCT Pub. Date: Oct. 1, 2020

(65) Prior Publication Data

US 2022/0183455 A1 Jun. 16, 2022

(51) Int. Cl.

| | |
|---|---|
| ***A46B 9/04*** | (2006.01) |
| ***A46B 3/00*** | (2006.01) |
| ***A46B 15/00*** | (2006.01) |

(52) U.S. Cl.
CPC ..... *A46B 9/04* (2013.01); *A46B 3/005* (2013.01); *A46B 15/0081* (2013.01); *A46B 2200/1066* (2013.01)

(58) Field of Classification Search
CPC ..... A46B 9/04; A46B 9/06; A46B 15/0081; A46B 2200/1066; A46B 3/005
(Continued)

(56) References Cited

U.S. PATENT DOCUMENTS 2,004,633 A 6/1935 Miller
2,224,788 A 12/1940 Jobst
(Continued)

FOREIGN PATENT DOCUMENTS

BR PI0807422 A2 * 7/2014
CA 2608763 A1 * 9/2007
(Continued)

OTHER PUBLICATIONS

English translation of CN 203016158 by Google Patents (Year: 2013).*
(Continued)

*Primary Examiner* — Brian D Keller
*Assistant Examiner* — Sukwoo James Chang

(57) ABSTRACT

An oral care implement (100) having a head (120). The head (120) has a support structure (130) and a monolithic cleaning unit (140) that is coupled to the support structure (130). The head (120) has a side surface (123) that includes a first lateral portion (124) and a second lateral portion (125). The monolithic cleaning unit (140) includes a base portion (141) that is coupled to the support structure (130) and a plurality of bristles (150) extending from the base portion (141). The plurality of bristles (150) include a plurality of first peripheral bristles (171) positioned adjacent to the first lateral portion (124) of the head (120), a plurality of second peripheral bristles (172) positioned adjacent to the second lateral portion (125) of the head (120), and a plurality of central bristles (175). The first and second peripheral bristles (171,172) all extend obliquely from the front surface (121) of the head (120) and the central bristles (175) extend perpendicularly from the front surface (121) of the head (120).

15 Claims, 10 Drawing Sheets

(58) Field of Classification Search
USPC ..... 15/167.1
See application file for complete search history.

(56) References Cited

U.S. PATENT DOCUMENTS

| | | | | |
|---|---|---|---|---|
| 2,567,080 | A | 9/1951 | Pifer | |
| 4,382,309 | A | 5/1983 | Collis | |
| 4,570,282 | A | 2/1986 | Kaufman et al. | |
| 5,065,470 | A | 11/1991 | Diamond | |
| 7,226,555 | B2 | 6/2007 | Weihrauch | |
| 9,572,419 | B2 * | 2/2017 | Bloch | A46B 15/0012 |
| 10,016,053 | B2 | 7/2018 | Hohlbein | |
| 10,136,723 | B2 | 11/2018 | Moskovich | |
| 10,588,398 | B2 | 3/2020 | Jimenez et al. | |
| 10,687,609 | B2 | 6/2020 | Waguespack | |
| 2014/0082871 | A1 | 3/2014 | Su et al. | |
| 2015/0074928 | A1 * | 3/2015 | Corbett | A46B 9/025 15/167.1 |
| 2017/0151044 | A1 * | 6/2017 | Okai | A61C 17/22 |
| 2017/0164725 | A1 * | 6/2017 | Moskovich | A46B 3/005 |
| 2018/0064239 | A1 * | 3/2018 | Xi | A46B 9/028 |
| 2018/0289143 | A1 | 10/2018 | Jimenez et al. | |

FOREIGN PATENT DOCUMENTS

| | | | |
|---|---|---|---|
| CN | 1156398 | * | 8/1997 |
| CN | 1347290 | | 5/2002 |
| CN | 201831194 | | 5/2011 |
| CN | 202104467 | | 1/2012 |
| CN | 102772004 | | 11/2012 |
| CN | 103099426 | | 5/2013 |
| CN | 203016158 | * | 6/2013 |
| CN | 103200840 | | 7/2013 |
| CN | 206238726 | | 6/2017 |
| EP | 1299017 | | 4/2003 |
| KR | 20150143241 | | 12/2015 |
| WO | 2008/135953 | | 11/2008 |
| WO | 2010/062009 | | 6/2010 |
| WO | 2017/076839 | | 5/2017 |
| WO | 2017/095735 | | 6/2017 |
| WO | 2019/055364 | | 3/2019 |
| WO | WO-2019055364 A1 | * | 3/2019 |

OTHER PUBLICATIONS

English translation of CN 1156398 by Google Patents (Year: 1997).*
English translation of BRPI0807422A2 (Year: 2014).*
International Search Report and the Written Opinion of the International Searching Authority issued in International Application PCT/CN2019/079214 dated Dec. 20, 2019.

* cited by examiner

ORAL CARE IMPLEMENT

BACKGROUND

Conventional toothbrushes include a head with tooth cleaning elements thereon. In typical toothbrushes, the tooth cleaning elements are bristles formed of nylon or a similar filament material. Due to the small diameter of such nylon bristles, a toothbrush may include thousands of discrete bristles arranged in tufts and coupled to the head, each of the discrete bristles forming a distinct end point for cleaning. Recently, toothbrushes have been manufactured with the bristles formed via injection molding. In such toothbrushes, the bristles are much larger than conventional filament bristles and as a result there are many fewer bristles on the head, which results in fewer end points for cleaning. In toothbrushes using this newer technology, if a user brushes too hard the bristles may quickly splay and be unable to return to their original position. Furthermore, the bristles may not be configured in such a manner that optimizes the oral cavity cleaning. Thus, a need exists for a toothbrush having injection molded bristles with an enhanced bristle pattern and orientation to more effectively cleaning a user's teeth and other oral surface and prolong the life cycle of the toothbrush.

BRIEF SUMMARY

The present invention is directed to an oral care implement a head. The head has a support structure and a monolithic cleaning unit that is coupled to the support structure. The head has a side surface that includes a first lateral portion and a second lateral portion. The monolithic cleaning unit includes a base portion that is coupled to the support structure and a plurality of bristles extending from the base portion. The plurality of bristles includes a plurality of first peripheral bristles positioned adjacent to the first lateral portion of the head, a plurality of second peripheral bristles positioned adjacent to the second lateral portion of the head, and a plurality of central bristles. The first and second peripheral bristles all extend obliquely from the front surface of the head and the central bristles extend perpendicularly from the front surface of the head.

In one aspect, the invention may be an oral care implement comprising: a head comprising a support structure and a monolithic cleaning unit, the head having a front surface, a rear surface opposite the front surface, and a side surface extending between the front and rear surfaces, the side surface comprising a first lateral portion, a second lateral portion, and a distal portion extending between the first and second lateral portions, the monolithic cleaning unit comprising: a base portion coupled to the support structure and forming a portion of the front surface of the head; and a plurality of bristles extending from the base portion and protruding from the front surface of the head; wherein the plurality of bristles comprises a plurality of first peripheral bristles located adjacent to the first lateral portion of the side surface of the head, a plurality of second peripheral bristles located adjacent to the second lateral portion of the side surface of the head, and a plurality of central bristles located between the plurality of first peripheral bristles and the plurality of second peripheral bristles; and wherein each of the plurality of central bristles extends perpendicularly from the front surface of the head, and wherein each of the plurality of first peripheral bristles and each of the plurality of second peripheral bristles extends obliquely from the front surface of the head.

In another aspect, the invention may be an oral care implement comprising: a head comprising a support structure and a monolithic cleaning unit, the head having a front surface, a rear surface opposite the front surface, and a side surface extending between the front and rear surfaces, the side surface comprising a first lateral portion, a second lateral portion, and a distal portion extending between the first and second lateral portions, the monolithic cleaning unit comprising: a base portion coupled to the support structure and forming a portion of the front surface of the head; and a plurality of bristles extending from the base portion and protruding from the front surface of the head; wherein the plurality of bristles comprises a plurality of first peripheral bristles located adjacent to the first lateral portion of the side surface of the head, a plurality of second peripheral bristles located adjacent to the second lateral portion of the side surface of the head, a plurality of third peripheral bristles located adjacent to the distal portion of the side surface of the head, and a plurality of fourth peripheral bristles located adjacent to a proximal end of the head; and wherein each of the first peripheral bristles and each of the second peripheral bristles extends obliquely from the front surface of the head, and wherein each of the third peripheral bristles and each of the fourth peripheral bristles extends perpendicularly from the front surface of the head.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
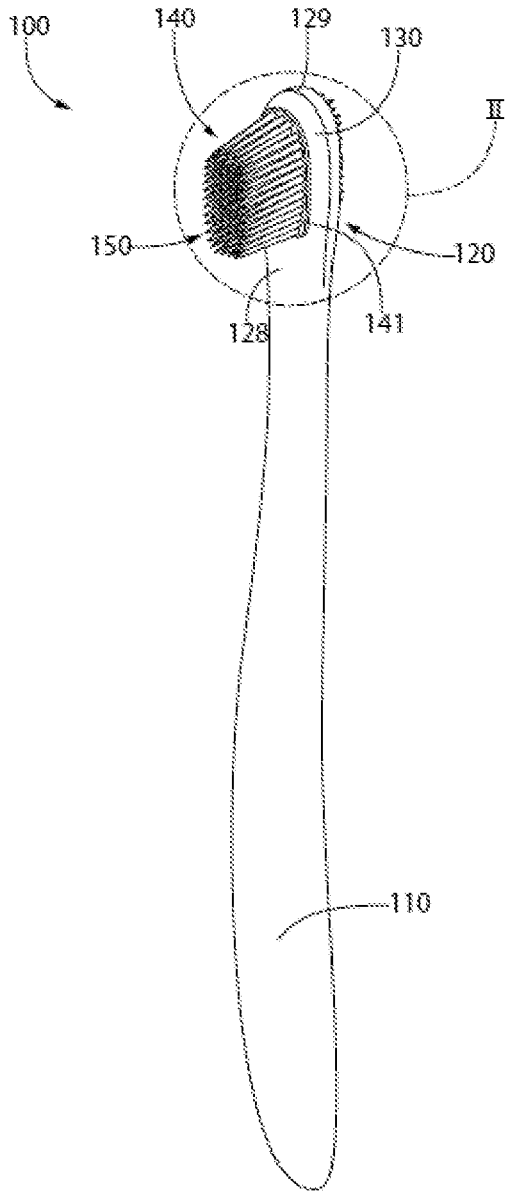
FIG. 1 is a front perspective view of an oral care implement in accordance with an embodiment of the present invention.
Figure 2:
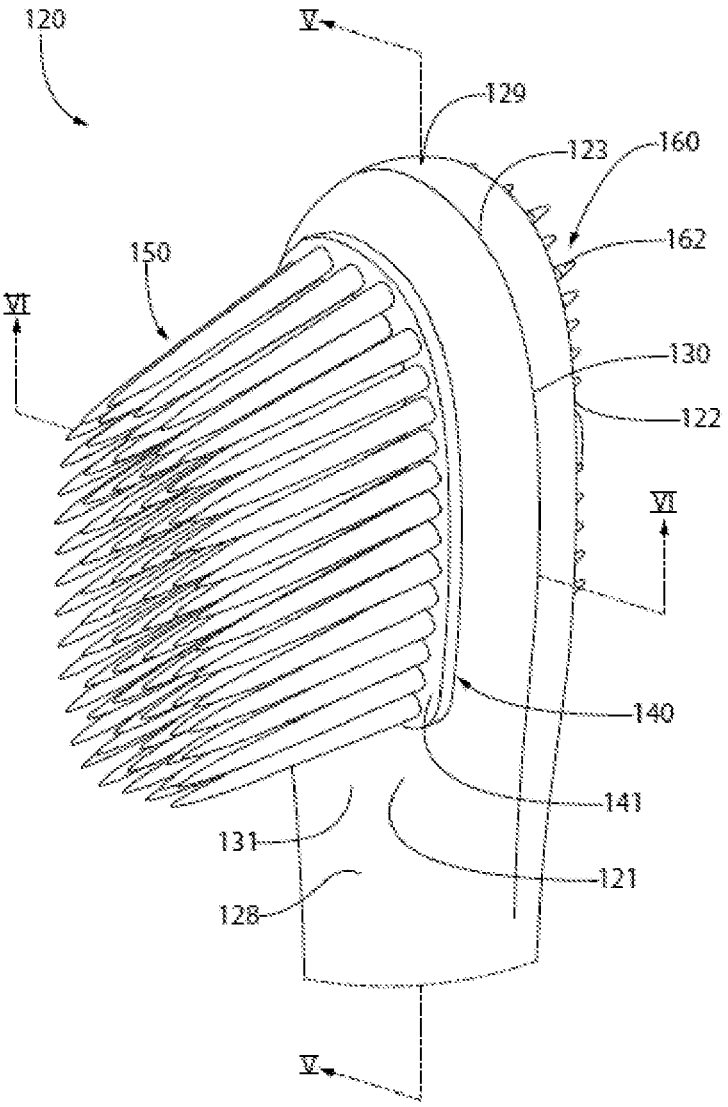
FIG. 2 is a close-up view of area II of FIG. 1 illustrating a head of the oral care implement.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring first to FIG. 1, an oral care implement 100 is illustrated in accordance with an embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having cleaning elements, or any other type of implement that is commonly used for oral care. In one particular embodiment illustrated in FIG. 10, the oral care implement 100 may be a refill head or replacement head that is configured to be coupled to a handle. In such embodiments, the refill head may be used with an electric or powered toothbrush or with a manual toothbrush.

The oral care implement 100 generally comprises a handle 110 and a head 120. The handle 110 is an elongated structure that provides the mechanism by which the user can hold and manipulate the oral care implement 100 during use. In the exemplified embodiment, the handle 110 is generically depicted having various contours for user comfort. Of course, the invention is not to be limited by the specific shape illustrated for the handle 110 in all embodiments and in certain other embodiments the handle 110 can take on a wide variety of shapes, contours, and configurations, none of which are limiting of the present invention unless so specified in the claims.

The handle 110 may be formed of a hard or rigid plastic material, such as for example without limitation polymers and copolymers of ethylene, propylene, butadiene, vinyl compounds, and polyesters such as polyethylene terephthalate. The handle 110 may also include a grip that is formed of a resilient/elastomeric material, such as a thermoplastic elastomer. Such a grip may be molded over a portion of the handle 110 that is typically gripped by a user's thumb and forefinger during use. Furthermore, it should be appreciated that additional regions of the handle 110 can be overmolded with the resilient/elastomeric material to enhance the gripability of the handle 110 during use. For example, portions of the handle 110 that are typically gripped by a user's palm during use may be overmolded with a thermoplastic elastomer or other resilient material to further increase comfort to a user. Furthermore, materials other than those noted above can be used to form the handle 110, including metal, wood, or any other desired material that has sufficient structural rigidity to permit a user to grip the handle 110 and manipulate the oral care implement 100 during toothbrushing. In some embodiments, the handle 110 may be formed of an elastomeric material such as thermoplastic elastomers and silicone including liquid silicone rubber.

Referring to FIGS. 1-6 concurrently, in the exemplified embodiment the head 120 of the oral care implement 100 comprises a support structure 130 and a monolithic cleaning unit 140. In the exemplified embodiment, the support structure 130 of the head 120 is formed integrally with the handle 110 as a single unitary structure using a molding, milling, machining, or other suitable process. However, in other embodiments the handle 110 and the support structure 130 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus, the support structure 130 of the head 120 may, in certain embodiments, be formed of any of the rigid plastic materials described above as being used for forming the handle 110, although the invention is not to be so limited in all embodiments and other materials that are commonly used during toothbrush head manufacture may also be used.

The monolithic cleaning unit 140 is coupled to the support structure 130 so that the monolithic cleaning unit 140 and the support structure 130 collectively form the head 120. More specifically, the monolithic cleaning unit 140 generally comprises a base portion 141 that is coupled directly to the support structure 130 and a plurality of bristles 150 extending from the base portion 141. The base portion 141 and all of the plurality of bristles 150 are integrally formed as a single unitary structure (i.e., the monolithic cleaning unit 140). Thus, the monolithic cleaning unit 140 is a one-piece structure that is affixed to the support structure 130. In the exemplified embodiment, the monolithic cleaning unit 140 includes all of the bristles on the head 120. Thus, the head 120 does not include any bristles or other tooth cleaning elements that are not formed as an integral part of the monolithic cleaning unit 140.

The head 120 of the oral care implement 100 extends from a proximal end 128 that is adjacent to the handle 110 to a distal end 129 along a longitudinal axis A-A. Furthermore, the head 120 comprises a front surface 121 and an opposing rear surface 122. The head 120 also comprises a side surface 123 extending between the front and rear surface 121, 122 and forming an outer periphery of the head 120. In the exemplified embodiment, the side surface 123 is formed entirely by the support structure 130 of the head 120. The side surface 123 comprises a first lateral portion 124, a second lateral portion 125, and a distal portion 126 extending between the first and second lateral portions 124, 125. The distal portion 126 of the side surface 123 comprises the distal end 129 of the head 120 and the first and second lateral portions 124, 125 of the side surface 123 extend from the distal portion 126 to the proximal end 128 of the head 120.

In the exemplified embodiment, the support structure 130 comprises a front surface 131 that forms a portion of the front surface 121 of the head 120 and a rear surface 136 opposite the front surface 131. Furthermore, the support structure 130 comprises a basin 132 formed into the front surface 131. The basin 132 is defined by a floor 134 and sidewalls 133 extending from the floor 134 to the front surface 131 of the support structure 130. The basin 132 forms a cavity within which the base portion 141 of the monolithic cleaning unit 140 may be disposed. Moreover, the support structure 130 comprises a plurality of openings 135 extending through the floor 134 of the basin 132. This allows the monolithic cleaning unit 140, when injection molded onto the support structure 130, to flow through the openings 135 to form a tongue cleaner on the rear surface 122 of the head 120, as described in more detail below.

In the exemplified embodiment, the support structure 130 also comprises a rear basin 137 formed into the rear surface 136. The rear basin 137 is defined by a floor 138 and a sidewall 139 that extends from the floor 138 to the rear surface 136. In the exemplified embodiment, a portion of the monolithic cleaning unit 140 that forms a soft tissue or tongue cleaner nests within the rear basin 137 of the support structure 130, as described more fully below.

As mentioned above, the monolithic cleaning unit 140 is an integral structure that includes both the base portion 141 and the bristles 150. Thus, all of the bristles 150 and the base portion 141 are formed integrally as a single, unitary, monolithic structure. The monolithic cleaning unit 140 may include between 65 and 90 of the bristles 150 in some embodiments, although more or less of the bristles 150 may be included in other embodiments depending on the surface area or tufting area of the head 120 and the spacing between the bristles 150. In some embodiments the head 120 may be devoid of filament bristles extending therefrom. In some embodiments the head comprises 120 tooth cleaning elements that consist only of the plurality of bristles 150 of the monolithic cleaning unit 140. Thus, in such embodiments the only tooth cleaning elements extending from the front surface 121 of the head 120 are the bristles 150 of the monolithic cleaning unit 140.

In the exemplified embodiment, the monolithic cleaning unit 140 comprises, in addition to the base portion 141 and the bristles 150, a soft tissue cleaner portion 160. Specifically, the soft tissue cleaner portion 160 of the monolithic cleaning unit 140 comprises a pad portion 161 and a plurality of protrusions or nubs 162 extending from the pad portion 161. The pad portion 161 of the soft tissue cleaner portion 160 of the monolithic cleaning unit 140 is positioned within the rear basin 137 of the support structure 130 and the protrusions 162 extend from the pad portion 161 and protrude from the rear surface 122 of the head 120. In the exemplified embodiment, an exposed outer surface of the pad portion 161 is flush with the rear surface 136 of the support structure 130. However, this is not required in all embodiments and the exposed outer surface of the pad portion 161 may be recessed relative to or may protrude from the rear surface 136 of the support structure 130 in alternative embodiments. The protrusions 162 protrude from the exposed outer surface of the pad portion 161.

The monolithic cleaning unit 140 also comprises an anchor portion 165 that connects the pad portion 161 of the soft tissue cleaner portion 160 to the base portion 141. Specifically, the anchor portion 165 extends through the openings 135 in the floor 134 of the support structure 130 to connect the pad portion 161 and the base portion 141 together so that the monolithic cleaning unit 140 is an integral structure.

Figure 5:
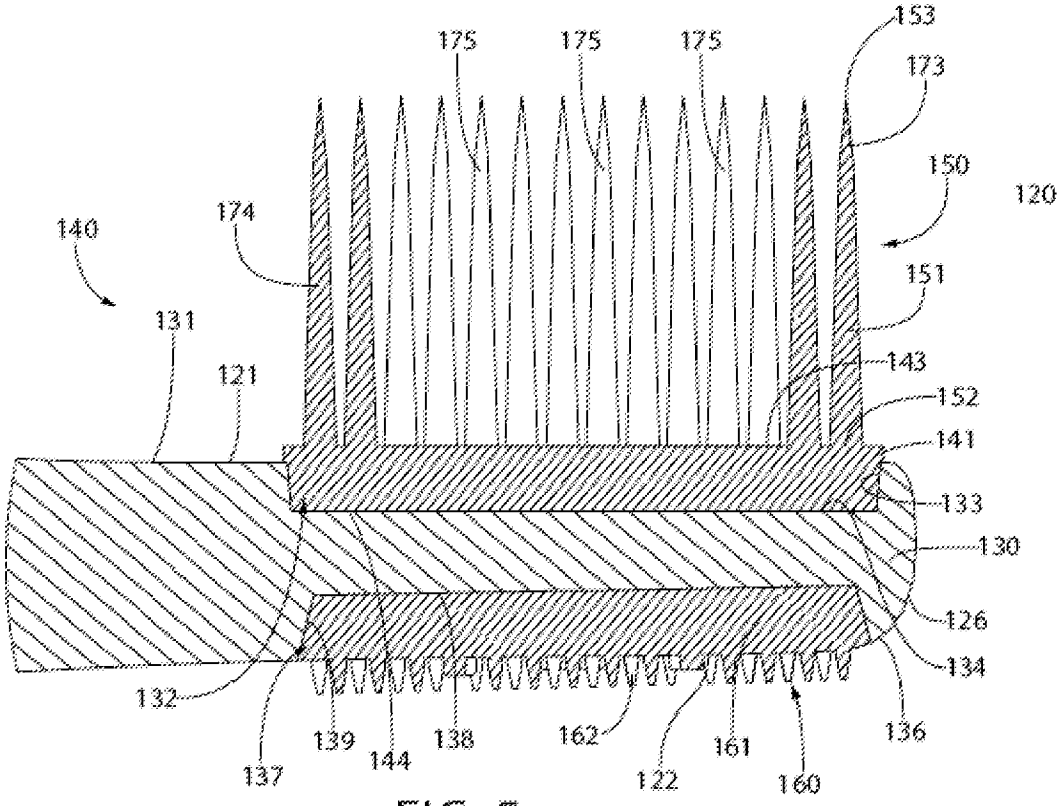
FIG. 5 is a cross-sectional view taken along line V-V of FIG. 2.
Figure 6:
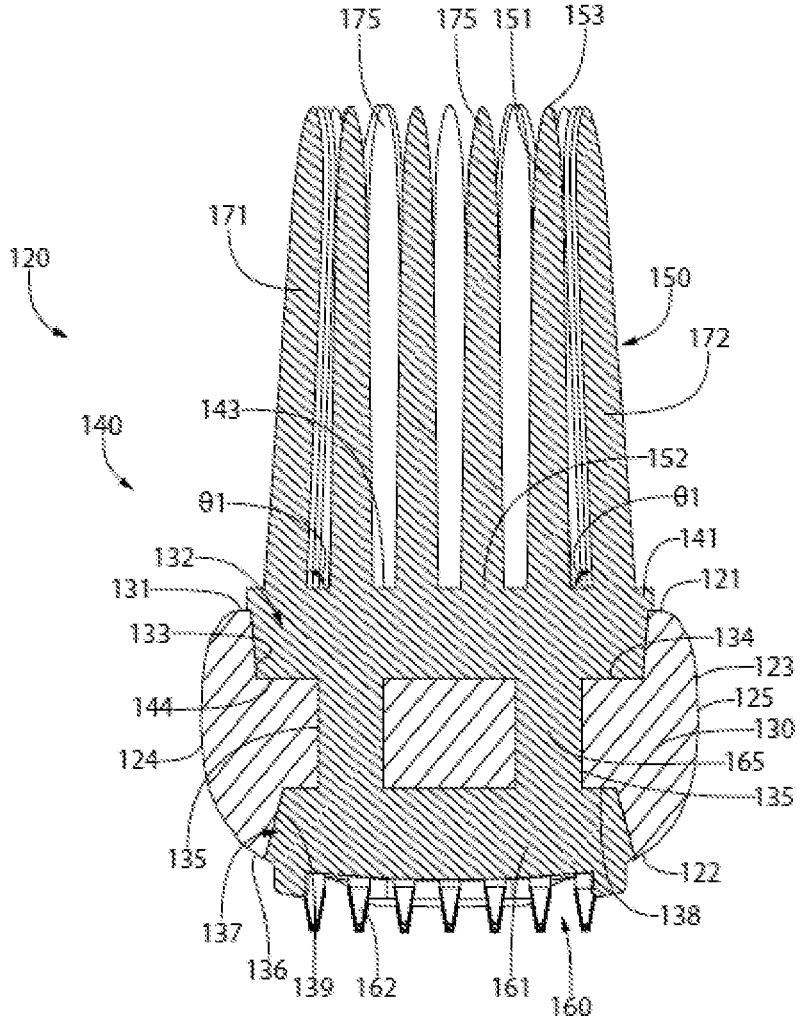
FIG. 6 is a cross-sectional view taken along line VI-VI of FIG. 2.

In certain embodiments the monolithic cleaning unit 140 may be formed via injection molding. Specifically, the support structure 130 of the head 120 may be positioned within a mold cavity, and a material may be injected into the mold cavity to simultaneously form the base portion 141, the bristles 150, the soft tissue cleaner portion 160 and the anchor portion 165 of the monolithic cleaning unit 140 in a single shot. The bristles 150 and the protrusions 162 are preferably solid structures as illustrated in FIGS. 5 and 6 and not hollow. In the exemplified embodiment, the bristles 150 are intended for cleaning the teeth and gums and the protrusions 162 are intended for cleaning the tongue. In that regard, the bristles 150 may have a length that is greater than the length of the protrusions 162. The monolithic cleaning unit 140, and more specifically the bristles 150 thereof, may be referred to herein and in the art as injection molded bristles. In certain embodiments, the monolithic cleaning unit 140 may be an integrally formed structure formed of an elastomeric material. The elastomeric material used to form the monolithic cleaning unit 140 may be thermoplastic polyurethane (TPU), thermoplastic elastomer (TPE), silicone, or the like.

In the fully formed head 120 of the embodiment, the base portion 141 of the monolithic cleaning unit 140 is positioned within the basin 132 of the support structure 130 and the bristles 150 of the monolithic cleaning unit 140 extend or protrude from the front surface 121 of the head 120 (and also from the front surface 131 of the support structure 130 and from a front surface 143 of the base portion 141 of the monolithic cleaning unit 140). In this embodiment, the monolithic cleaning unit 140 is coupled to the support structure 130 so that the front surface 143 of the base portion 141 of the monolithic cleaning unit 140 is flush with the front surface 131 of the support structure 130. In this way, the front surface 143 of the base portion 141 of the monolithic cleaning unit 140 and the front surface 131 of the support structure 130 collectively form the front surface 121 of the head 120. Of course, the front surface 143 of the base portion 141 of the monolithic cleaning unit 140 need not be flush with the front surface 131 of the support structure 130 in all embodiments and the front surface 143 of the base portion 141 of the monolithic cleaning unit 140 may be recessed relative to or extend beyond the front surface 131 of the support structure 130 in alternative embodiments. In some embodiments the support structure 130 may be omitted and the entire head 120 may be formed from the monolithic cleaning unit 140, which would in such embodiments be coupled directly to the handle 110 of the oral care implement 100.

The base portion 141 of the monolithic cleaning unit 140 is disposed directly atop of the front surface 131 of the support structure 130. Thus, a rear surface 144 of the base portion 141 is positioned directly atop and in direct surface contact with the floor 134 of the cavity 132 of the support structure 130. In certain embodiments, the base portion 141 of the monolithic cleaning unit 140 may have a thickness measured from the rear surface 144 of the base portion 141 of the monolithic cleaning unit 140 to the front surface 143 of the base portion 141 of the monolithic cleaning unit 140 of between 0.5 mm and 1.5 mm, more specifically between 0.6 mm and 1.0 mm, and still more specifically approximately 0.8 mm. Maintaining a low profile and low thickness for the base portion 141 ensures that the head 120 of the oral care implement 100 will fit comfortably within a user's mouth during toothbrushing. The base portion 141 of the monolithic cleaning unit 140 may have a longitudinal length L1 of between 14 mm and 18 mm. Of course, thicknesses and longitudinal lengths of the base portion 141 of the monolithic cleaning unit 140 may be outside of the noted ranges in some embodiments.

The front surface 143 of the base portion 141 of the monolithic cleaning unit 140 is exposed at the front surface 121 of the head 120. Stated another way, the front surface 143 of the base portion 141 of the monolithic cleaning unit 140 forms at least a portion of the front surface 121 of the head 120, with the front surface 131 of the support structure 130 forming the remaining portion of the front surface 121 of the head 120. Thus, the front surface 131 of the support structure 130 and the front surface 143 of the base portion 141 of the monolithic cleaning unit 140 collectively form the entirety of the front surface 121 of the head 120. In the exemplified embodiment, the base portion 141 protrudes from the front surface 131 of the support structure 130, and thus the front surface 143 of the base portion 141 is elevated relative to the front surface 131 of the support structure 130. Nonetheless, the front surface 143 of the base portion 141 and the front surface 131 of the support structure 130 collectively form the front surface 121 of the head 120.

In certain embodiments the front surface 143 of the base portion 141 of the monolithic cleaning unit 140 may form greater than 80%, or greater than 85%, or greater than 90%, or greater than 95% of the surface area of the front surface 121 of the head 120. In some embodiments the front surface 131 of the support structure 130 forms a perimeter portion of the front surface 121 of the head 120 and the front surface 143 of the base portion 141 of the monolithic cleaning unit 140 forms an interior portion of the front surface 121 of the head 120 that is substantially, or entirely, surrounded by the front surface 131 of the support structure 130. In other embodiments, the front surface 143 of the base portion 141 of the monolithic cleaning unit 140 may form the entire front surface 121 of the head 120.

In some embodiments, the monolithic cleaning unit 140 may also extend over the distal end of the support structure 130. In such an embodiment, the openings 135 may be included or omitted as desired. Specifically, the openings 135 are used in the exemplified embodiment in order to securely couple the monolithic cleaning unit 140 to the support structure 130. However, if the monolithic cleaning unit 140 extends over the front and rear surfaces 131, 136 of the support structure 130 and also over the distal end of the support structure 130, such passageways may not be needed to achieve the coupling of the monolithic cleaning unit 140 to the support structure 130. Other techniques for ensuring a secure coupling between the monolithic cleaning unit 140 and the support structure 130 are within the scope of the present invention, such as using various combinations of interlocking features on the monolithic cleaning unit 140 and the support structure 130.

In the embodiment exemplified, the bristles 150 of the monolithic cleaning unit 140 are all in the shape of a tapered cylinder having smooth outer surfaces. Specifically, the bristles 150 may have a tapered cylinder shape (also known as a truncated cone or a frusto-cone). Thus, in the embodiment exemplified in FIGS. 1-6, the bristles 150 comprise a body 151 that extends along a longitudinal axis from a proximal end 152 that is adjacent to or in contact with or that extends directly from the base portion 141 of the monolithic cleaning unit 140 to a distal end 153 that is spaced from the front surface 121 of the head 120. In this embodiment, the body 151 is cylindrical (round, oval, tapered), conical, or the like. The distal end 153 of the bristle 150 may be flat, rounded, tapered, slanted, or the like as desired to achieve different cleaning benefits.

Although the bristles 150 are illustrated herein as comprising a body 151 having a cylindrical or conical shape (with a round or oval transverse cross-sectional shape), the invention is not to be so limited in all embodiments. When the body 151 has a cylindrical shape, this may include oval cylinders, tapered cylinders, cones, truncated cones, frusto-conical shaped structures, or the like. Furthermore, in some embodiments the body 151 of the bristles 150 may have a shape that is not cylindrical or round, such as having triangular, square, rectangular, or other polygonal shaped transverse cross-sections. Thus, the body 151 of the bristles 150 may be cylindrical, conical, or prism-shaped and the body 151 may be tapered. Various combinations of differently shaped bristles may be included on the head 120 of the oral care implement 100. In some embodiments, as with the exemplified embodiment, all of the bristles on the head 120 of the oral care implement 100 are identical in structure. In other embodiments, different shaped bristles may form part of the monolithic cleaning unit 140 and be provided on the same head 120.

In some embodiments such as the one exemplified, the bristles 150 are all tapered. Furthermore, in the exemplified embodiment the bristles 150 taper more rapidly in one direction than in the other. This can be seen best in FIGS. 5 and 6. Specifically, in the side view of FIG. 6, the bristles 150 taper relatively quickly and terminate at a point. In the end view of FIG. 6, the bristles 150 taper slower and terminate in a rounded end. This results in the bristles 150 having a trowel-like shape. Of course, this is simply one embodiment and in other embodiments the bristles 150 may taper continuously from all sides at the same rate of taper, the bristles 150 may not taper at all, or anything in between.

Figure 7:
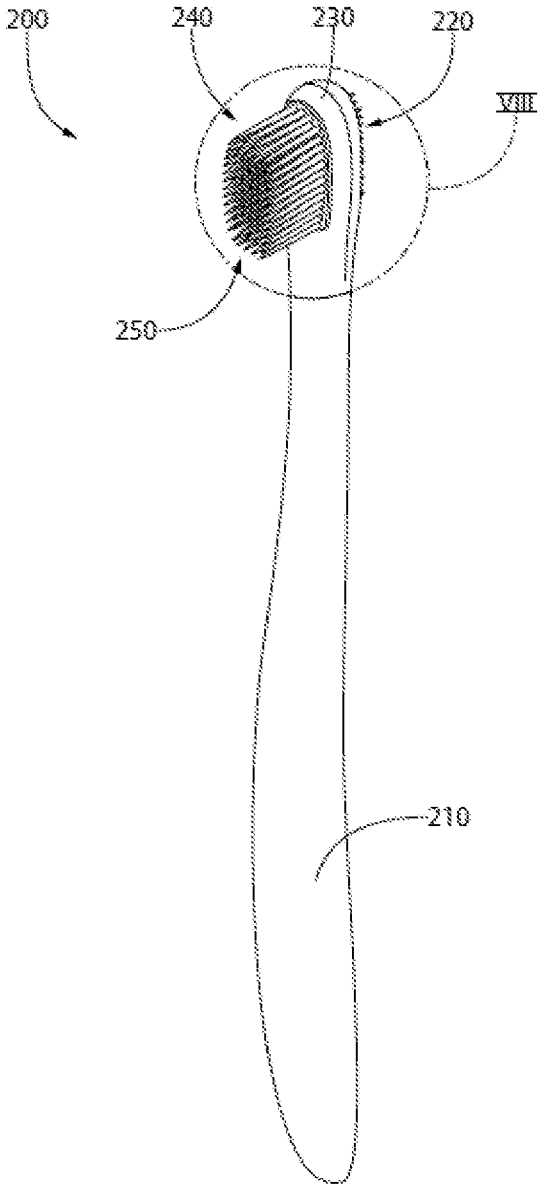
FIG. 7 is a front perspective view of an oral care implement in accordance with another embodiment of the present invention.
Figure 8:
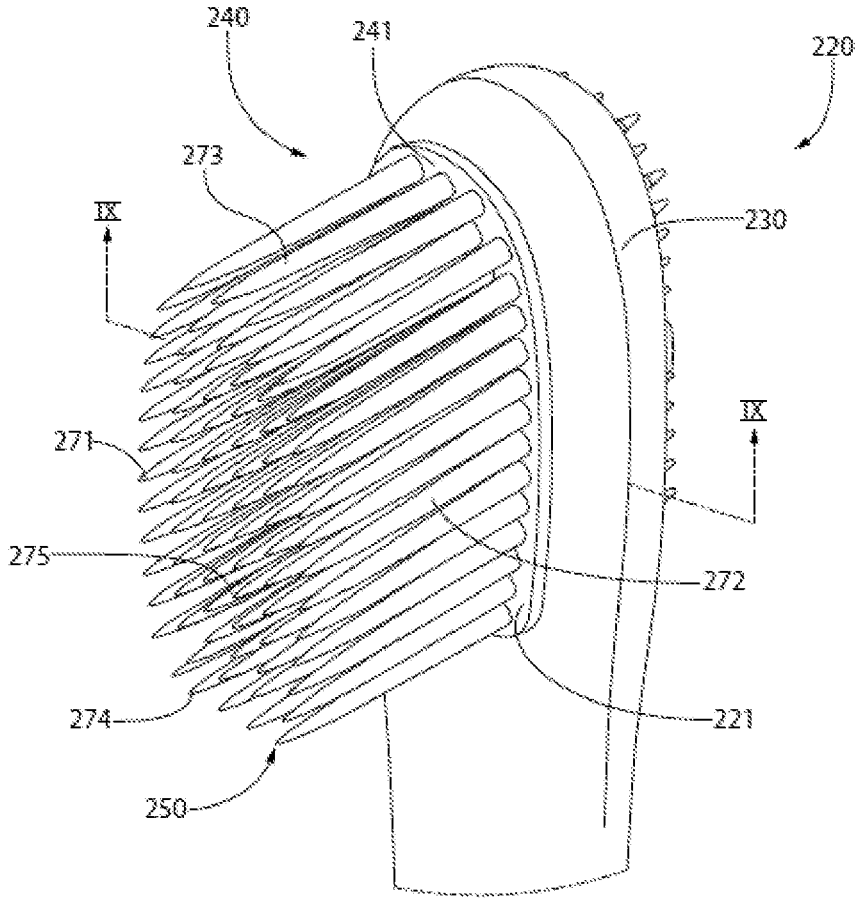
FIG. 8 is a close-up view of area VIII of FIG. 7.
Figure 9:
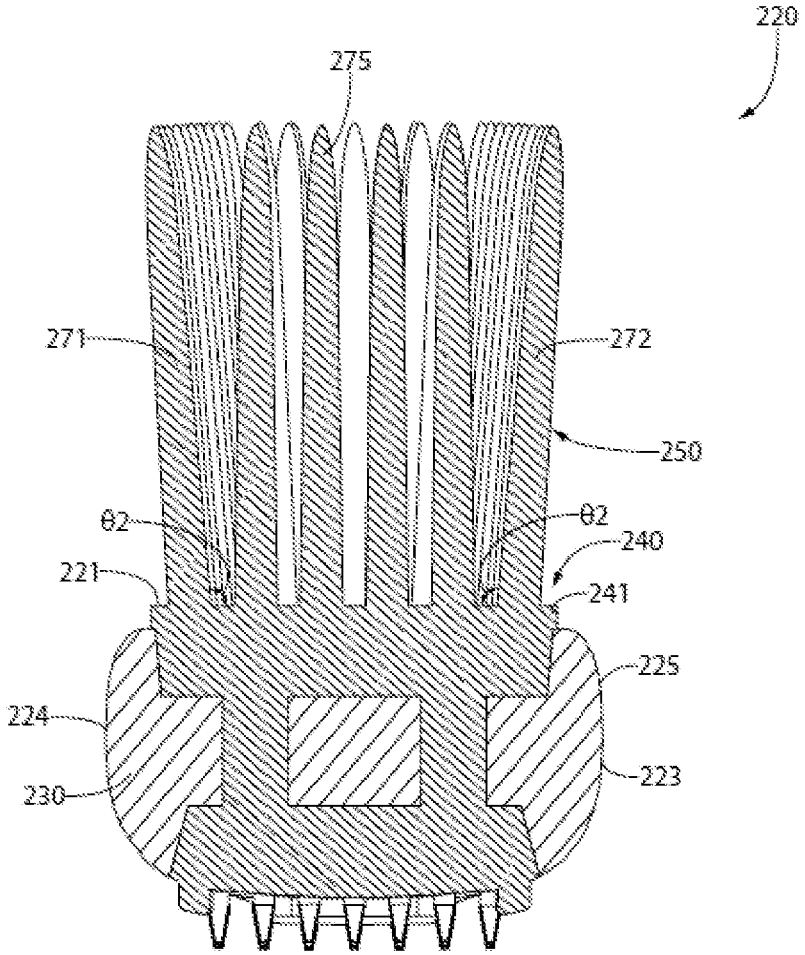
FIG. 9 is a cross-sectional view taken along line IX-IX of FIG. 8.

In certain embodiments, the bristles 150 may have a maximum diameter of between 0.5 mm and 2.0 mm, more specifically between 0.7 mm and 1.3 mm, and more specifically approximately 0.8 mm and 1.2 mm. Furthermore, the bristles 150 may have a length, measured in the direction of its axis from its proximal end 152 to its distal end 153, of between 8 mm and 14 mm, and more specifically between 10 mm and 12 mm. In certain embodiments, a ratio of the length of the bristles 150 to the maximum diameter of the bristles 150 may be between 8:1 and 20:1, or more specifically between 10:1 and 15:1, and still more specifically between 10:1 and 12:1. This length to diameter ratio for the bristles 150 may be applicable to all embodiments of the bristles described herein. All of the bristles 150 of the monolithic cleaning unit 140 may have the same length as illustrated in FIGS. 6 and 7 or they may have varying lengths. As noted above, in the embodiment exemplified the bristles 150 may have a tapered cylindrical shape. Thus, the maximum diameter of the bristles 150 is the diameter of the bristles 150 at the proximal end 152. The diameter and the cross-sectional area of the bristles 150 may decrease with distance from the proximal end 152 towards the distal end 153.

Figure 3:
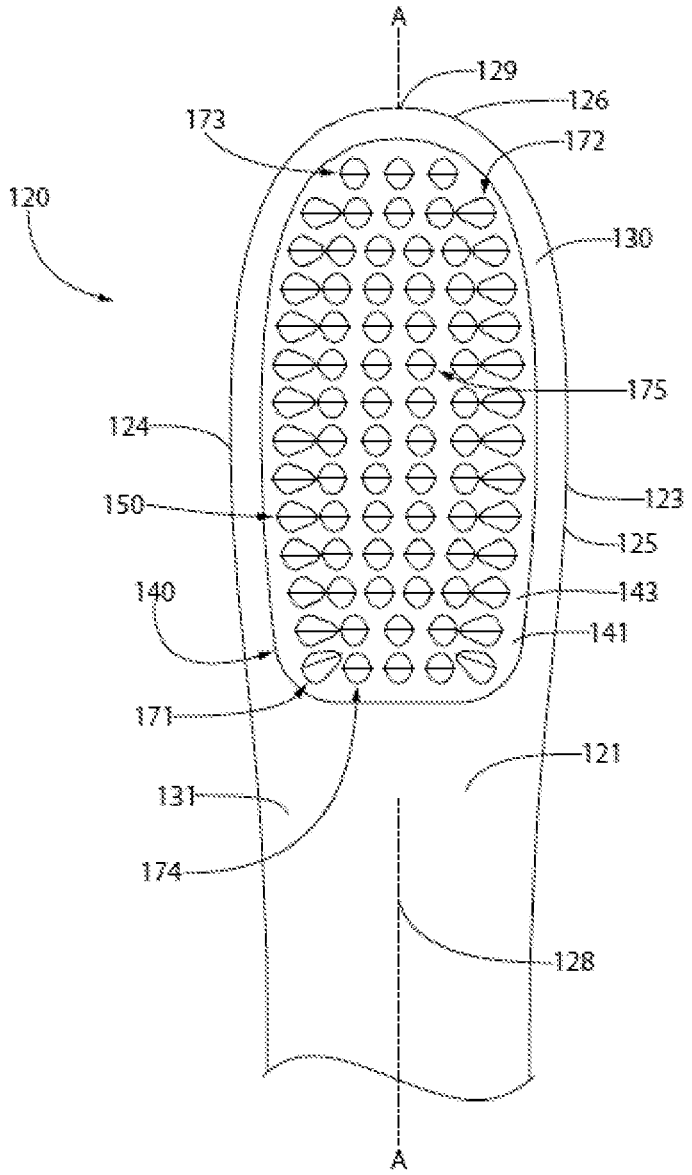
FIG. 3 is a front view of the head of the oral care implement of FIG. 1.
Figure 4:
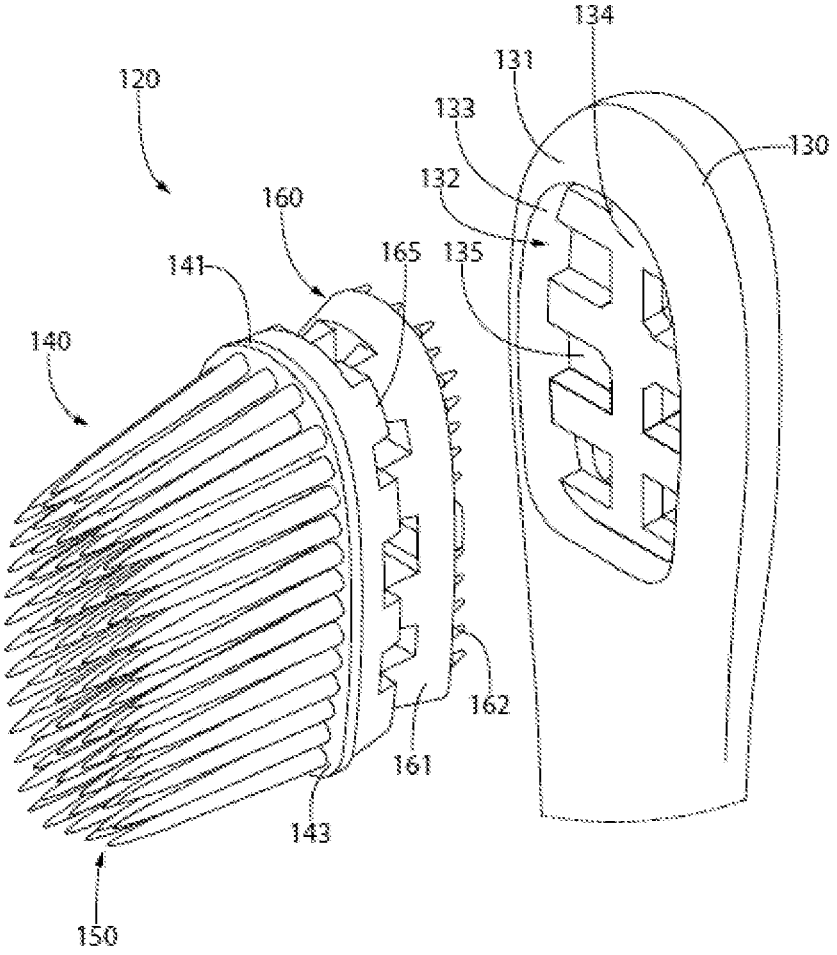
FIG. 4 is an exploded view of the head of the oral care implement of FIG. 1.

Referring to FIGS. 3, 5, and 6, the bristles 150 of the monolithic cleaning unit 140 will be further described. The bristles 150 comprise a plurality of first peripheral bristles 171, a plurality of second peripheral bristles 172, a plurality of third peripheral bristles 173, a plurality of fourth peripheral bristles 174, and a plurality of central bristles 175. The plurality of first peripheral bristles 171 are positioned on the head 120 and located adjacent to the first lateral portion 124 of the side surface 123 of the head 120. The plurality of second peripheral bristles 172 are positioned on the head 120 and located adjacent to the second lateral portion 125 of the side surface 123 of the head 120. The plurality of third peripheral bristles 173 are positioned on the head 120 and located adjacent to the distal portion 126 of the side surface 123 of the head 120. The plurality of fourth peripheral bristles 174 are positioned on the head 120 and located adjacent to the proximal end 128 of the head 120. The plurality of central bristles 175 are located in the interior of the collection of peripheral bristles 171-174. Specifically, the plurality of first, second, third, and fourth peripheral bristles 171-174 collectively surround the plurality of central bristles 175.

The first, second, third, and fourth peripheral bristles 171-174 are the bristles positioned closest to the side surface 123 of the head 120. Thus, there are no bristles positioned between the first peripheral bristles 171 and the first lateral portion 124 of the side surface 123, between the second peripheral bristles 172 and the second lateral portion 125 of the side surface 123, and between the third peripheral bristles 173 and the distal portion 126 of the side surface 123. Moreover, there are no bristles positioned between the fourth peripheral bristles 174 and the proximal end 128 of the head 120. The first, second, third, and fourth peripheral bristles 171-174 collectively form a wall (despite the bristles being spaced apart from one another) that surrounds the plurality of central bristles 175.

Each of the plurality of first peripheral bristles 171 extends obliquely from the front surface 121 of the head 120. Each of the plurality of second peripheral bristles 172 extends obliquely from the front surface 121 of the head 120. Each of the plurality of third peripheral bristles 173 extends perpendicularly from the front surface 121 of the head 120. Each of the plurality of fourth peripheral bristles 174 extends perpendicularly from the front surface 121 of the head 120. And finally, each of the plurality of central bristles 175 extends perpendicular from the front surface 121 of the head 120.

In the exemplified embodiment, the first and second peripheral bristles 171, 172 are angled relative to the front surface 121 of the head 120 in a direction towards one another. Specifically, as mentioned above the head 120 comprises a longitudinal axis A-A. The longitudinal axis A-A lies in a reference plane that is perpendicular to the front surface 121 of the head 120. The first and second peripheral bristles 171, 172 extend from the front surface 121 of the head 120 obliquely and in a direction such that the first and second peripheral bristles 171, 172 converge towards the reference plane with increasing distance from the front surface 121 of the head 120. Thus, each of the first peripheral bristles 171 extends from the front surface 121 of the head 120 in a direction away from the first lateral portion 124 of the side surface 123 of the head 120 and towards the second lateral portion 125 of the side surface 123 of the head 120. Furthermore, each of the second peripheral bristles 172 extends from the front surface 121 of the head 120 in a direction away from the second lateral portion 125 of the side surface 123 of the head 120 and towards the first lateral portion 124 of the side surface 123 of the head 120.

In the exemplified embodiment, each of the first peripheral bristles 171 and each of the second peripheral bristles 172 is oriented at an angle θ1 relative to the front surface 121 of the head 120, the angle θ1 being between 80° and 89°. In the exemplified embodiment, the angle between each of the first peripheral bristles 171 and the front surface 121 of the head 120 and the angle between each of the second peripheral bristles 172 and the front surface 121 of the head 120 is the same. However, in other embodiments various ones of the first and second peripheral bristles 171, 172 may extend from the front surface 121 of the head 120 are varying angles.

Despite the angled orientation of the first and second peripheral bristles 171, 172, the first and second peripheral bristles 171, 172 are entirely spaced apart from each of the central bristles 175. Thus, for example, although each of the first peripheral bristles 171 extends in a direction towards one of the central bristles 175 that is adjacent to that first peripheral bristle 171, the first peripheral bristle 171 is spaced apart from the central bristle 175 even at the distal end thereof. The same is true of the second peripheral bristles 172. Each of the first and second peripheral bristles 171, 172 is spaced a first distance from an adjacently positioned one of the central bristles 175 at the proximal end 152 thereof and a second distance from the adjacently positioned one of the central bristles 175 at the distal end 153 thereof, the first distance being greater than the second distance. However, because the bristles 150 are tapered in the exemplified embodiment, the first and second distances could be the same in some embodiments despite the fact that the first and second peripheral bristles 171, 172 are angled towards the adjacently positioned central bristles 175. This is perhaps best shown in FIG. 6.

By angling the bristles 150 in the manner described above and depicted in the accompanying figures, a tighter bristle field is formed, which allows for a more precise cleaning of the teeth and oral surfaces. Specifically, because the first and second peripheral bristles 171, 172 are angled inwardly towards the longitudinal axis A-A, the first and second peripheral bristles 171, 172 are less likely to splay outwardly during and after use. This allows the user to have pinpoint accuracy when cleaning teeth, gums, and the like using the oral care implement 100.

As mentioned above, in the exemplified embodiment the third peripheral bristles 173 and the fourth peripheral bristles 174 extend perpendicularly from the front surface 121 of the head 120. However, in other embodiments the third peripheral bristles 173 may extend obliquely from the front surface 121 of the head 120, for example such as being angled in a direction away from the distal end 129 and towards the proximal end 128 of the head. Moreover, in other embodiments the fourth peripheral bristles 174 may extend obliquely from the front surface 121 of the head 120, for example such as being angled in a direction away from the proximal end 128 and towards the distal end 129 of the head 120.

Despite the fact that the first and second peripheral bristles 171, 172 are angled relative to the front surface 121 of the head 120 while the remaining bristles are perpendicular to the front surface 121 of the head 120, the distal ends 153 of the bristles 150 collectively form a flat trim profile. Thus, the distal ends 153 of the bristles 150 lie in a common plane that is oriented horizontally and parallel to the front surface 121 of the head 120 (and more specifically to the front surface 143 of the base portion 141 of the monolithic cleaning unit 140). Stated another way, the linear distance between the distal ends 153 of each of the bristles 150 and the front surface 143 of the base portion 141 of the monolithic cleaning unit 140 is the same for each of the bristles 150 in the exemplified embodiment. However, in alternative embodiments it may be possible for the bristles 150 to have different linear lengths to create different trim profiles.

As best seen in FIG. 3, the bristles 150 are arranged in rows that are transverse to the longitudinal axis A-A, as described more fully herein below. Putting the distal-most row (i.e., the row closest to the distal end 129 of the head 120) and the proximal-most row (i.e., the row closest to the proximal end 128 of the head 120) aside, each of the rows comprises one of the first peripheral bristles 171, one of the second peripheral bristles 172, and at least two of the central bristles 175. In fact, in the exemplified embodiment each of the rows comprises one of the first peripheral bristles 171, one of the second peripheral bristles 172, and three or four of the central bristles 175. Of course, more of the central bristles 175 could be included in each row, dictated by the surface area of the front surface 121 of the head 120. Furthermore, in the exemplified embodiment there is one column of the first peripheral bristles 171 and one column of the second peripheral bristles 172, which results in each row having one of the first and one of the second peripheral bristles 171, 172. However, in other embodiments there could be multiple columns of the first and/or second peripheral bristles 171, 172, resulting in more than one of the first and/or second peripheral bristles 171, 172 being in each row.

In the exemplified embodiment, the distal-most row of the bristles 150 that is adjacent to the distal end 129 of the head 120 comprises only the third peripheral bristles 173. Specifically, in the exemplified embodiment the distal-most row of the bristles 150 comprises exactly three of the third peripheral bristles 173, which all extend perpendicularly from the front surface 121 of the head 120. Of course, the invention is not to be so limited in all embodiments and one of the first and/or one of the second peripheral bristles 171, 172 may also be included in the distal-most row in other embodiments.

In the exemplified embodiment, the proximal-most row of the bristles 150 that is adjacent to the proximal end 129 of the head 120 comprises one of the first peripheral bristles 171, one of the second peripheral bristles 172, and the plurality of the fourth peripheral bristles 174. Specifically, in the exemplified embodiment the proximal-most row of the bristles 150 comprises exactly three of the fourth peripheral bristles 174, although more or less could be included in other embodiments. As stated previously, while the first and second peripheral bristles 171, 172 of the proximal-most row of the bristles 150 extend obliquely from the front surface 121 of the head 120, the fourth peripheral bristles 174 extend perpendicularly from the front surface 121 of the head 120 in the exemplified embodiment.

Referring to FIG. 7, an oral care implement 200 is illustrated in accordance with another embodiment of the present invention. The oral care implement 200 is very similar to the oral care implement 100, without only the differences between the oral care implement 200 and the oral care implement 100 being described herein. Certain features of the oral care implement 200 will not be described herein in the interest of brevity, it being understood that the description of the oral care implement 100 above is applicable. Where possible, the features of the oral care implement 200 will be similarly numbered to the features of the oral care implement 100 except that the 200-series of numbers will be used. Features of the oral care implement 200 that are not numbered or described that appear to be identical to features of the oral care implement 100 that were previously described should be considered to be the same as the feature of the oral care implement 100 such that the description provided above is applicable.

The oral care implement 200 comprises a handle 210 and a head 220. The head 220 comprises a support structure 230 and a monolithic cleaning unit 240. The monolithic cleaning unit 240 comprises a base portion 241 and a plurality of bristles 250. The plurality of bristles 250 comprises a first plurality of peripheral bristles 271, a second plurality of peripheral bristles 272, a third plurality of peripheral bristles 273, a fourth plurality of peripheral bristles 274, and a plurality of central bristles 275. The bristles 250 are arranged on the head 120 in exactly the same manner as described above with regard to the oral care implement 100, except that the manner in which the plurality of first peripheral bristles tufts 271 and the plurality of second peripheral bristle tufts 272 are oriented. Thus, the bristles 250 are arranged in rows similarly to that which is best shown in FIG. 3.

The plurality of third peripheral bristles 273, the plurality of fourth peripheral bristles 274, and the plurality of central bristles 275 are oriented so as to extend perpendicularly from the front surface 221 of the head 220. The plurality of first peripheral bristles 271 and the plurality of second peripheral bristles 272 are oriented so as to extend obliquely from the front surface 221 of the head 220. Specifically, the plurality of first peripheral bristles 271 and the plurality of second peripheral bristles 272 are oriented at an angle θ2 relative to the front surface 221 of the head 220. In the exemplified embodiment, the angle θ2 is between 91° and 100°.

As with the previous embodiment, the head 220 comprises a longitudinal axis that lies in a reference plane that is perpendicular to the front surface 221 of the head 220. In this embodiment, each of the first peripheral bristles 271 is angled relative to the front surface 221 of the head 220 so as to diverge from the reference plane with increasing distance from the front surface 221 of the head 220. Thus, each of the first peripheral bristles 271 extends from the head 220 in a direction towards the first lateral portion 224 of the side surface 223 of the head 220. The distal ends of the first peripheral bristles 271 are closer to the first lateral portion 224 and further from the longitudinal axis than the proximal ends of the first peripheral bristles 271. Similarly, each of the second peripheral bristles 272 is angled relative to the front surface 221 of the head 220 so as to diverge from the reference plane with increasing distance from the front surface 221 of the head 220. Thus, each of the second peripheral bristles 272 extends from the head 220 in a direction towards the second lateral portion 225 of the side surface 223 of the head 220. The distal ends of the second peripheral bristles 272 are closer to the second lateral portion 225 and further from the longitudinal axis than the proximal ends of the second peripheral bristles 272.

The configuration of the bristles 250 of the oral care implement 200 allows the bristles 250 to clean the oral surfaces more broadly during a cleaning session. Specifically, while the central cleaning elements 275 are cleaning the outer surfaces of the teeth, the first peripheral bristles 271 may be cleaning the gums while the second peripheral bristles 272 may be cleaning the distal tips of the teeth. Thus, cleaning efficiency and speed may be reduced when using the oral care implement 200.

Figure 10:
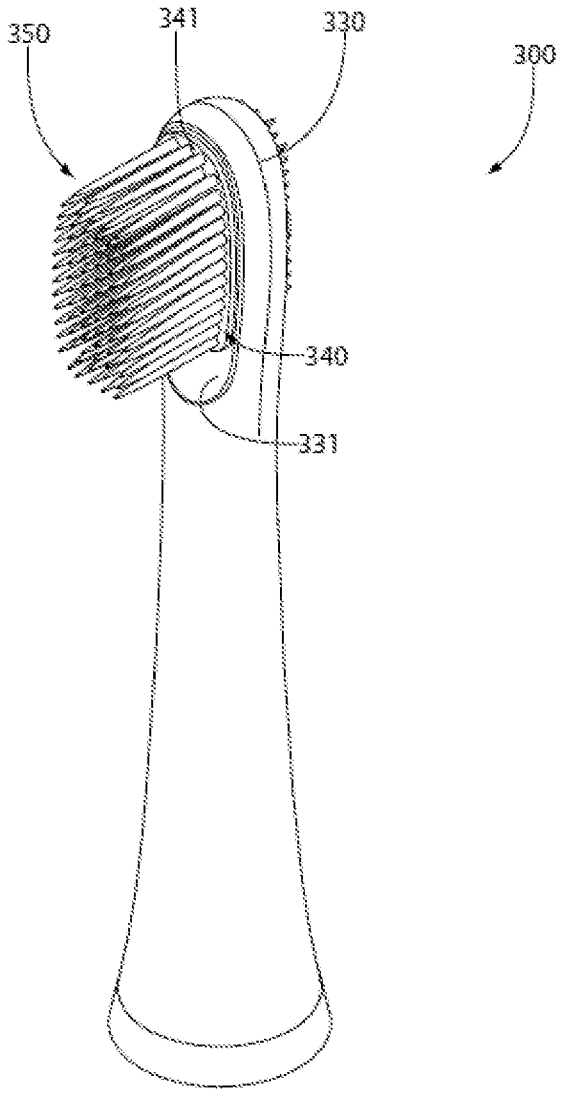
FIG. 10 is a front perspective view of a refill head in accordance with an embodiment of the present invention.

Referring to FIG. 10, an oral care implement 300 is illustrated in accordance with an embodiment of the present invention. In this embodiment, the oral care implement 300 is a refill head which is configured to be coupled to a handle of an oral care implement, which may be a powered or a manual oral care implement when assembled. The oral care implement 300 includes a support structure 330 and a monolithic cleaning unit 340 coupled to the support structure 330. The monolithic cleaning unit 340 comprises a base portion 341 and a plurality of bristles 350 extending from the base portion 341 and protruding from a front surface 331 of the support structure 330. The bristles 350 may have the pattern, configuration, orientation, and structure as described above with regard to the oral care implement 100 or with regard to the oral care implement 200. Thus, FIG. 10 seeks to demonstrate that the inventive features described herein could be used on a toothbrush or on a refill head for a toothbrush.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

The invention claimed is:

1. An oral care implement comprising:

a head comprising a support structure and a monolithic cleaning unit, the head having a front surface, a rear surface opposite the front surface, and a side surface extending between the front and rear surfaces, the side surface comprising a first lateral portion, a second lateral portion, and a distal portion extending between the first and second lateral portions, the monolithic cleaning unit comprising:

a base portion coupled to the support structure and forming a portion of the front surface of the head; and a plurality of bristles extending from the base portion and protruding from the front surface of the head;

wherein the plurality of bristles comprises a plurality of first peripheral bristles located adjacent to the first lateral portion of the side surface of the head, a plurality of second peripheral bristles located adjacent to the second lateral portion of the side surface of the head, and a plurality of central bristles located between the plurality of first peripheral bristles and the plurality of second peripheral bristles;

wherein each of the plurality of central bristles extends perpendicularly from the front surface of the head, and wherein each of the plurality of first peripheral bristles and each of the plurality of second peripheral bristles extends obliquely from the front surface of the head; and wherein the plurality of bristles further comprises a plurality of third peripheral bristles located adjacent to the distal portion of the side surface of the head and a plurality of fourth peripheral bristles located adjacent to a proximal end of the head, each of the plurality of third and fourth peripheral bristles extending perpendicularly from the front surface of the head;

wherein each of the plurality of bristles is symmetrically tapered in two directions; and wherein each of the plurality of first peripheral bristles and second peripheral bristles is tapered more rapidly in one of the directions than in the other.

2. The oral care implement according to claim 1 further comprising:

the head having a longitudinal axis that lies in a reference plane that is perpendicular to the front surface of the head; and each of the first peripheral bristles and each of the second peripheral bristles being angled relative to the front surface of the head so as to converge towards the reference plane with increasing distance from the front surface of the head.

3. The oral care implement according to claim 2 wherein each of the first peripheral bristles and each of the second peripheral bristles extends from a proximal end that is adjacent to the base portion to a distal end, and wherein each of the first peripheral bristles and each of the second peripheral bristles is spaced a first distance from an adjacently positioned one of the central bristles at the proximal end and a second distance from the adjacently positioned one of the central bristles at the distal end, the first distance being greater than the second distance.

4. The oral care implement according to claim 1 wherein the plurality of first, second, third, and fourth peripheral bristles collectively surround the plurality of central bristles.

5. The oral care implement according to claim 1 further comprising:

the head having a longitudinal axis that lies in a reference plane that is perpendicular to the front surface of the head; and each of the first peripheral bristles and each of the second peripheral bristles being angled relative to the front surface of the head so as to diverge from the reference plane with increasing distance from the front surface of the head.

6. The oral care implement according to claim 1 wherein the monolithic cleaning element further comprises:

a pad portion coupled to the support structure and forming a portion of the rear surface of the head; and a plurality of protrusions extending from the pad portion and protruding from the rear surface of the head, wherein each of the plurality of bristles has a greater length than each of the plurality of protrusions.

7. The oral care implement according to claim 6 wherein the monolithic cleaning unit further comprises an anchor portion that extends through the head and connects the pad portion of the monolithic cleaning unit to the base portion of the monolithic cleaning unit.

8. The oral care implement according to claim 1 wherein each of the plurality of first peripheral bristles and each of the plurality of second peripheral bristles is oriented at an angle between 80° and 89° relative to the front surface of the head.

9. The oral care implement according claim 1 wherein each of the plurality of bristles comprises a distal end, and wherein the distal ends of each of the plurality of bristles is spaced apart from and not in contact with the distal end of any of the other bristles.

10. The oral care implement according to claim 1 wherein there are no bristles located between the plurality of first peripheral bristles and the first lateral portion of the side surface of the head, and wherein there are no bristles located between the plurality of second peripheral bristles and the second lateral portion of the side surface of the head.

11. The oral care implement according to claim 1 wherein the head has a longitudinal axis and the plurality of bristles are arranged in rows that are transverse to the longitudinal axis, each of the rows comprising one of the first peripheral bristles, one of the second peripheral bristles, and at least two of the central bristles.

12. The oral care implement according to claim 1 wherein each of the plurality of bristles extends from the base portion to a distal end, and wherein the distal ends of the plurality of bristles lie in a common plane and form a flat trim profile.

13. The oral care implement according to claim 1 wherein the monolithic cleaning unit is formed from a thermoplastic elastomer.

14. The oral care implement according to claim 1 wherein the head is a part of a refill head that is configured to be detachably coupled to a handle of the oral care implement.

15. The oral care implement according to claim 1 wherein each of the plurality of bristles has a length between 10 mm and 12 mm and a maximum diameter between 0.5 mm and 2.0 mm.

* * * * *